US011346292B2

(12) United States Patent
Arai et al.

(10) Patent No.: US 11,346,292 B2
(45) Date of Patent: May 31, 2022

(54) GENERAL ENGINE THROTTLE APPARATUS

(71) Applicants: HONDA MOTOR CO., LTD., Tokyo (JP); CHONG QING HECHENG ELECTRIC APPLIANCE CO., LTD., Chongqing (CN)

(72) Inventors: Tetsuya Arai, Wako (JP); Yanbo Dong, Chongqing (CN); Jiang Yuan, Chongqing (CN); Hongxing Li, Chongqing (CN); Qiang Fu, Chongqing (CN)

(73) Assignees: HONDA MOTOR CO., LTD., Tokyo (JP); CHONGQING HECHENG ELECTRIC APPLIANCE CO., LTD., Chongqing (CN)

( * ) Notice: Subject to any disclaimer, the term of this patent is extended or adjusted under 35 U.S.C. 154(b) by 0 days.

(21) Appl. No.: 17/272,356

(22) PCT Filed: Sep. 5, 2018

(86) PCT No.: PCT/CN2018/104170

§ 371 (c)(1),
(2) Date: Mar. 1, 2021

(87) PCT Pub. No.: WO2020/047773

PCT Pub. Date: Mar. 12, 2020

(65) Prior Publication Data

US 2021/0317793 A1 Oct. 14, 2021

(51) Int. Cl.
*F02D 9/10* (2006.01)
*F02D 11/10* (2006.01)

(52) U.S. Cl.
CPC ..... *F02D 9/1065* (2013.01); *F02D 11/10* (2013.01); *F02D 11/106* (2013.01)

(58) Field of Classification Search
CPC ..... F02D 9/1065; F02D 11/10; F02D 11/106
(Continued)

(56) References Cited

U.S. PATENT DOCUMENTS 4,768,483 A 9/1988 Asayama
5,868,114 A * 2/1999 Kamimura ..... F02D 11/10 123/399

(Continued)

FOREIGN PATENT DOCUMENTS

CN 201747466 2/2011
CN 207649627 7/2018

(Continued)

OTHER PUBLICATIONS

International Search Report and Written Opinion for International Application No. PCT/CN2018/104170 dated Jan. 21, 2019, 7 pages.

*Primary Examiner* — Mahmoud Gimie
(74) *Attorney, Agent, or Firm* — Amin, Turocy & Watson, LLP

(57) ABSTRACT

A general engine throttle apparatus includes a throttle body 12, a throttle valve 13, a throttle shaft 14, a driven gear 24, an electrically driven motor 15, and a detected body block 26. The throttle valve 13 opens and closes an intake air introduction hole 11. The throttle shaft 14 holds the throttle valve 13 and is rotatably supported by a holding hole 16 of the throttle body 12. The electrically driven motor 15 transmits a rotation operation force to the driven gear 24. The detected body block 26 is attached to another end part in an axial direction of the throttle shaft 14, and a state of the throttle shaft 14 is detected by a sensor. The driven gear 24 is integrally formed on one end side in the axial direction of the throttle shaft 14. The detected body block 26 is formed to have a maximum outer diameter that is smaller than a minimum inner diameter of the holding hole 16.

3 Claims, 6 Drawing Sheets

(58) Field of Classification Search
USPC ..... 123/434
See application file for complete search history.

(56) References Cited

U.S. PATENT DOCUMENTS

| | | | | |
|---|---|---|---|---|
| 6,067,958 | A * | 5/2000 | Kamimura | F02D 9/1065 123/337 |
| 6,268,722 | B1 * | 7/2001 | Kogure | G01D 5/145 324/207.12 |
| 6,739,312 | B2 * | 5/2004 | Komeda | F02D 9/106 123/337 |
| 2003/0024505 | A1 | 2/2003 | Anschicks et al. | |

FOREIGN PATENT DOCUMENTS

| | | |
|---|---|---|
| EP | 0401823 | 12/1990 |
| EP | 1281848 | 2/2003 |
| JP | 63-085234 | 4/1988 |
| JP | 2005-016438 | 1/2005 |
| JP | 2006-097500 | 4/2006 |
| JP | 2009-019926 | 1/2009 |
| JP | 2009-287476 | 12/2009 |

* cited by examiner

GENERAL ENGINE THROTTLE APPARATUS

TECHNICAL FIELD

The present invention relates to a throttle apparatus of a general engine used in a lawn mower, an agricultural machine, a generator, and the like.

BACKGROUND

As a throttle apparatus of a general engine, such an apparatus is known which drives a throttle valve by an electrically driven motor.

In this type of throttle apparatus, a throttle shaft is rotatably supported by a throttle body having an intake air introduction hole, and a throttle valve is attached to the throttle shaft. The throttle shaft is rotatably supported by a holding hole formed on the throttle body.

In most of these types of throttle apparatuses, both end parts in an axial direction of the throttle shaft protrude to the outside of the holding hole of the throttle body. A driven gear for receiving a rotation operation force from the electrically driven motor is attached to one end side in the axial direction of the throttle shaft, and a detected body block is attached to another end side in the axial direction of the throttle shaft. The detected body block is a block that includes a detected body such as a magnet detected by a sensor. The detected body block has a configuration, for example, in which a magnet that is the detected body is held by a magnet case.

In the case of the throttle apparatus, the throttle shaft is first attached to the holding hole of the throttle body, and then a driven gear and the detected body block are attached to each end part of the throttle shaft protruding from the holding hole.

RELATED ART DOCUMENTS

Patent Documents

[Patent Document 1]
Japanese Unexamined Patent Application, First Publication No. 2005-16438
[Patent Document 2]
Japanese Unexamined Patent Application, First Publication No. 2006-97500
[Patent Document 3]
Japanese Unexamined Patent Application, First Publication No. 2009-287476

SUMMARY OF INVENTION

Problems to be Solved by the Invention

In the throttle apparatus described above, the throttle shaft and the driven gear need to be formed as separate components, and the driven gear and the detected body block need to be fixed to both end parts of the throttle shaft after the throttle shaft is attached to the holding hole. Therefore, in the throttle apparatus described above, the number of components is increased, and complicated assembly of the components is required.

A problem to be solved is to provide a general engine throttle apparatus capable of facilitating the fabrication.

Means for Solving the Problem

A general engine throttle apparatus according to an aspect of the present invention is a throttle apparatus of a general engine that includes: a throttle body that has an intake air introduction hole; a throttle valve that opens and closes the intake air introduction hole; a throttle shaft that holds the throttle valve and that is rotatably supported by a holding hole of the throttle body; a driven gear that is provided on one end part in an axial direction of the throttle shaft; an electrically driven motor that transmits a rotation operation force to the driven gear; and a detected body block which is attached to another end part in the axial direction of the throttle shaft and in which a state of the throttle shaft is detected by a sensor, wherein the driven gear and the detected body block are arranged on one end part and another end part of the throttle shaft that protrudes to an outside of the holding hole, respectively, and wherein the driven gear is integrally formed on one end side in the axial direction of the throttle shaft, and the detected body block is formed to have a maximum outer diameter that is smaller than a minimum inner diameter of the holding hole.

According to the configuration described above, the driven gear may be formed as an integral component on one end part in the axial direction of the throttle shaft by casting or the like. Further, since the detected body block is formed to have the maximum outer diameter that is smaller than the minimum inner diameter of the holding hole of the throttle body, when assembling the throttle shaft to the holding hole, the detected body block can be attached in advance to another end part in the axial direction of the throttle shaft. That is, in a state where the detected body block is assembled, the other end part in the axial direction of the throttle shaft can be inserted in and be attached to the holding hole.

A small diameter part having an outer diameter that is smaller than a shaft main body part held by the holding hole may be formed on the other end part in the axial direction of the throttle shaft, and the detected body block may be fitted to the small diameter part.

In this case, the detected body block having an outer diameter that is smaller than the minimum inner diameter of the holding hole can be easily attached to the other end part of the throttle shaft.

The detected body block may include a magnet that is a detected body and a magnet case that holds the magnet, and the magnet case may be fitted to the small diameter part and may be locked to the small diameter part by a support pin that penetrates through the small diameter part in a radial direction.

In this case, the magnet case that holds the magnet can be easily and stably attached to the other end part in the axial direction of the throttle shaft.

Advantage of the Invention

In the general engine throttle apparatus according to an aspect of the present invention, since the driven gear is molded as an integral component on the throttle shaft, it is possible to reduce the number of components and reduce the man-hours of assembly. Further, in the general engine throttle apparatus according to the aspect of the present invention, since the throttle shaft can be inserted in the holding hole and be attached to the throttle body in a state where the detected body block is attached to the throttle shaft in advance, it is possible to facilitate the assembly of components. Accordingly, by employing the general engine throttle apparatus according to the aspect of the present invention, it is possible to facilitate the fabrication.

DESCRIPTION OF THE EMBODIMENTS

Hereinafter, an embodiment of the present invention will be described with reference to the drawings.

Figure 1:
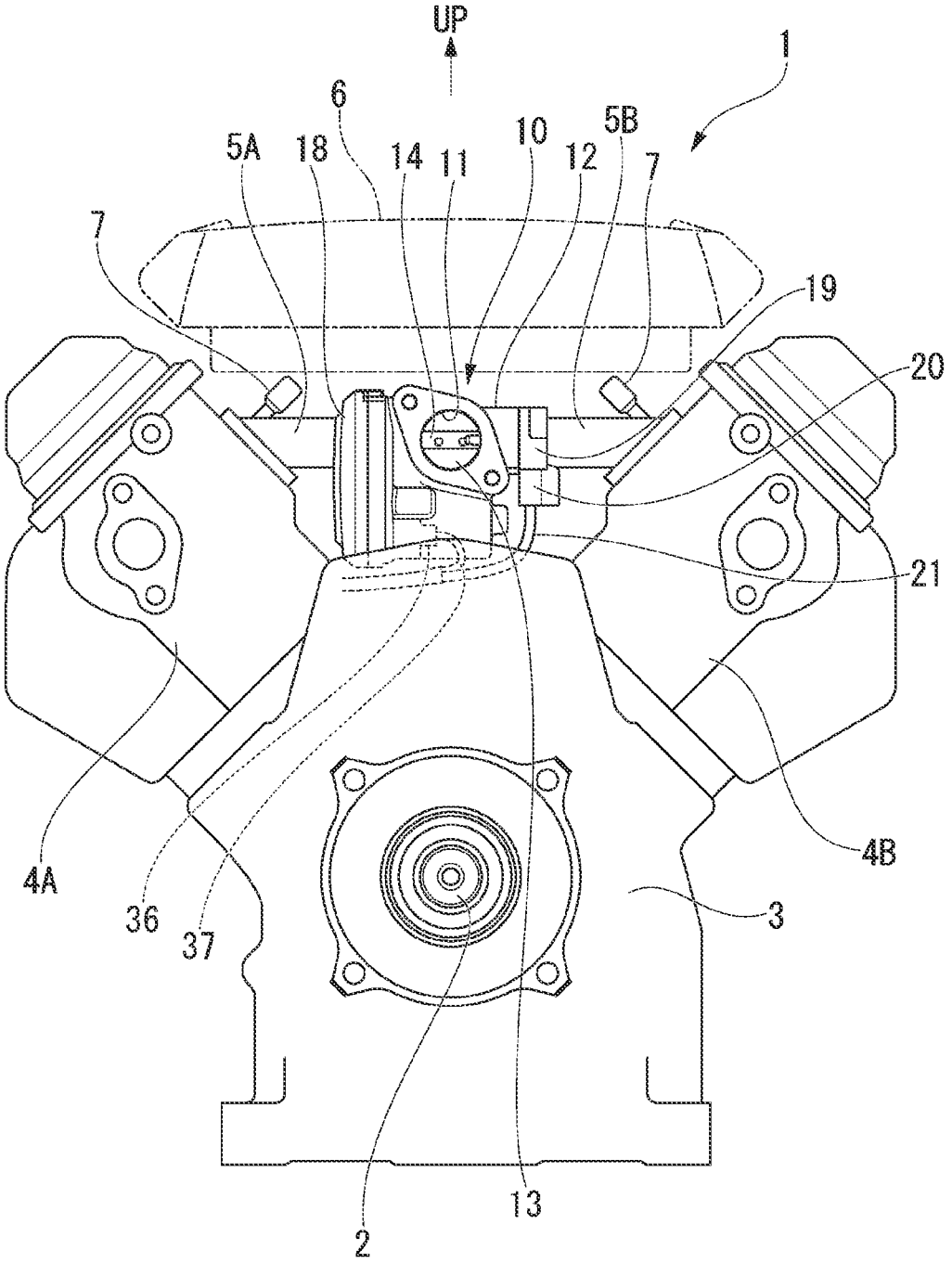
FIG. 1 is a front view of a general engine of an embodiment.

FIG. 1 is a front view of a general engine 1 on which a throttle apparatus 10 of an embodiment of the present invention is mounted.

The general engine 1 of the present embodiment is a V-type dual cylinder engine in which a crankshaft 2 that is an output shaft protrudes substantially horizontally from a crankcase 3. A pair of cylinder blocks 4A and 4B are connected to the crankcase 3 so as to define a substantially V shape. A piston (not shown) that is coupled to the crankshaft 2 in a power transmittable manner is slidably housed in each of the cylinder blocks 4A and 4B. A combustion chamber (not shown) is formed between the piston and a head part of each of the cylinder blocks 4A and 4B. Each of intake pipes 5A and 5B and an exhaust pipe (not shown) are connected to each combustion chamber via an intake valve (not shown) and an exhaust valve (not shown).

The intake pipes 5A and 5B of each cylinder are arranged in a space having a substantially V shape sandwiched between the two cylinder blocks 4A and 4B above the crankcase 3. Each of the intake pipes 5A and 5B is connected to an air cleaner 6 via a common throttle apparatus 10. When the general engine 1 is driven, the flow rate of air suctioned through the air cleaner 6 is adjusted by the throttle apparatus 10. A fuel injection device 7 is arranged on each of the intake pipes 5A, 5B such that the fuel injection device 7 is directed toward a combustion chamber direction of the corresponding cylinder. The air that passes through the throttle apparatus 10 branches at the intake pipes 5A and 5B and is introduced into the combustion chamber of each cylinder together with a fuel injected from the fuel injection device 7.

Figure 2:
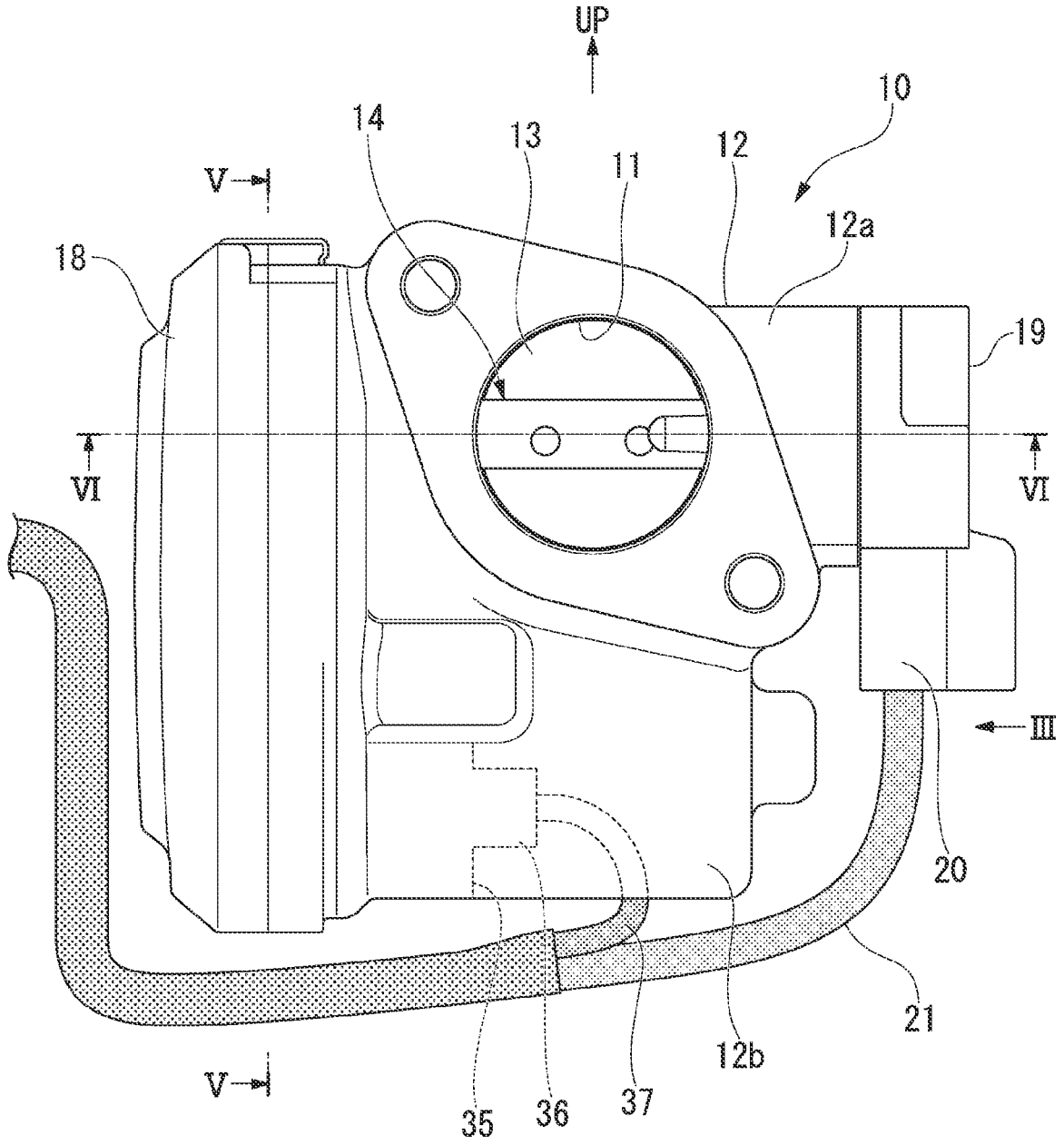
FIG. 2 is a front view of a throttle apparatus of the embodiment.
Figure 3:
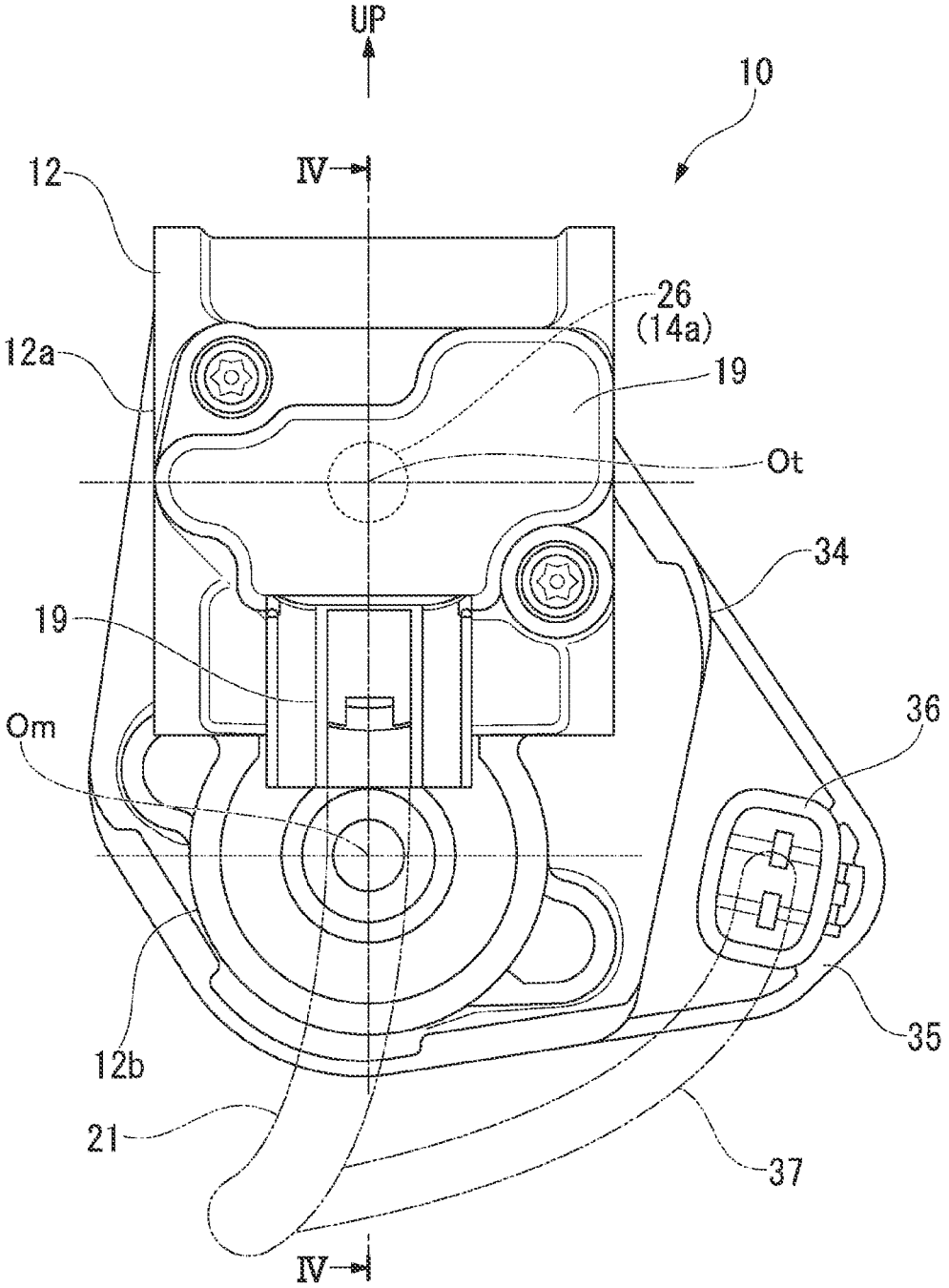
FIG. 3 is a view seen in an arrow III direction of FIG. 2 of the throttle apparatus of the embodiment.
Figure 4:
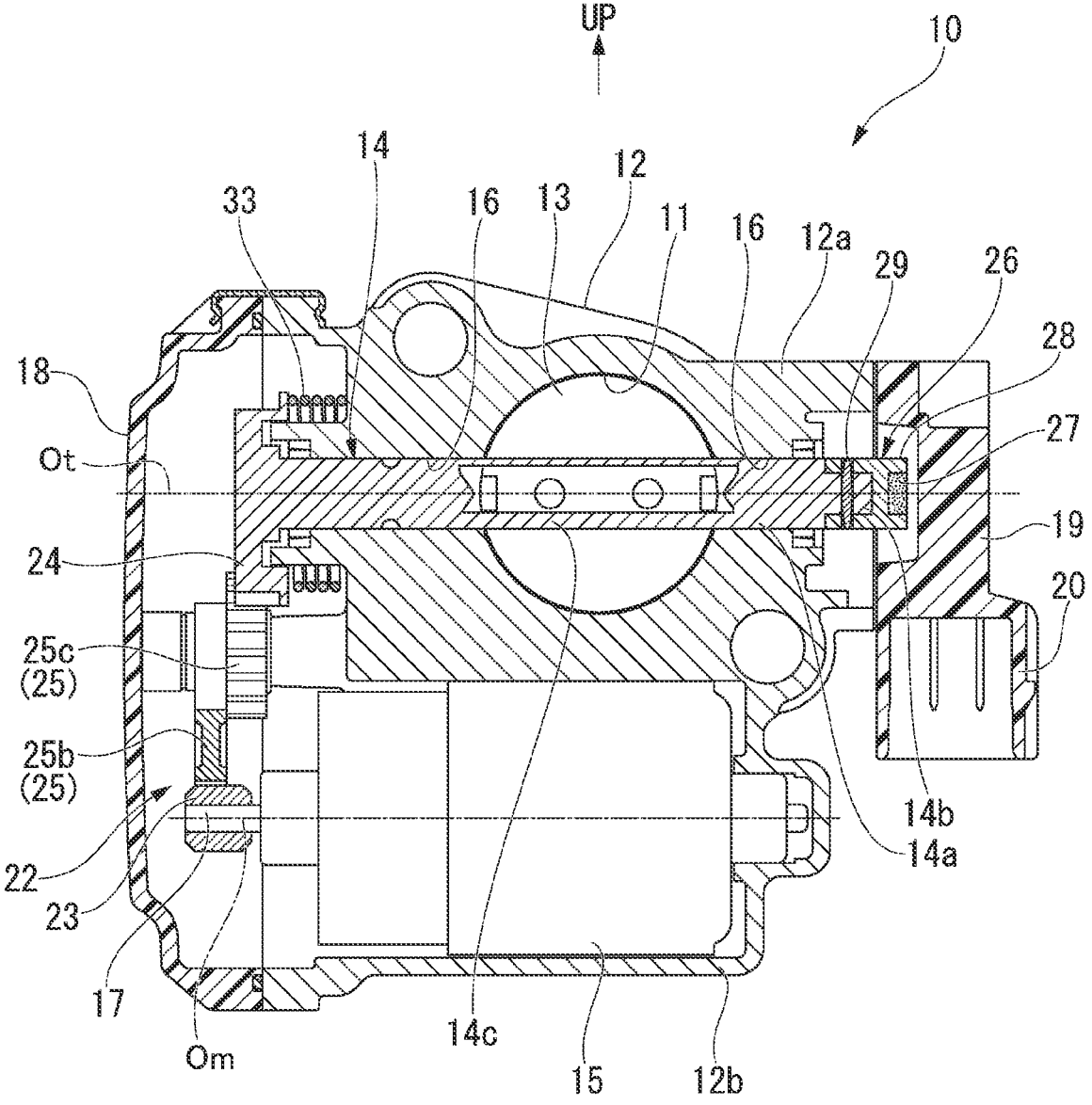
FIG. 4 is a cross-sectional view along a line IV-IV of FIG. 3 of the throttle apparatus of the embodiment.
Figure 5:
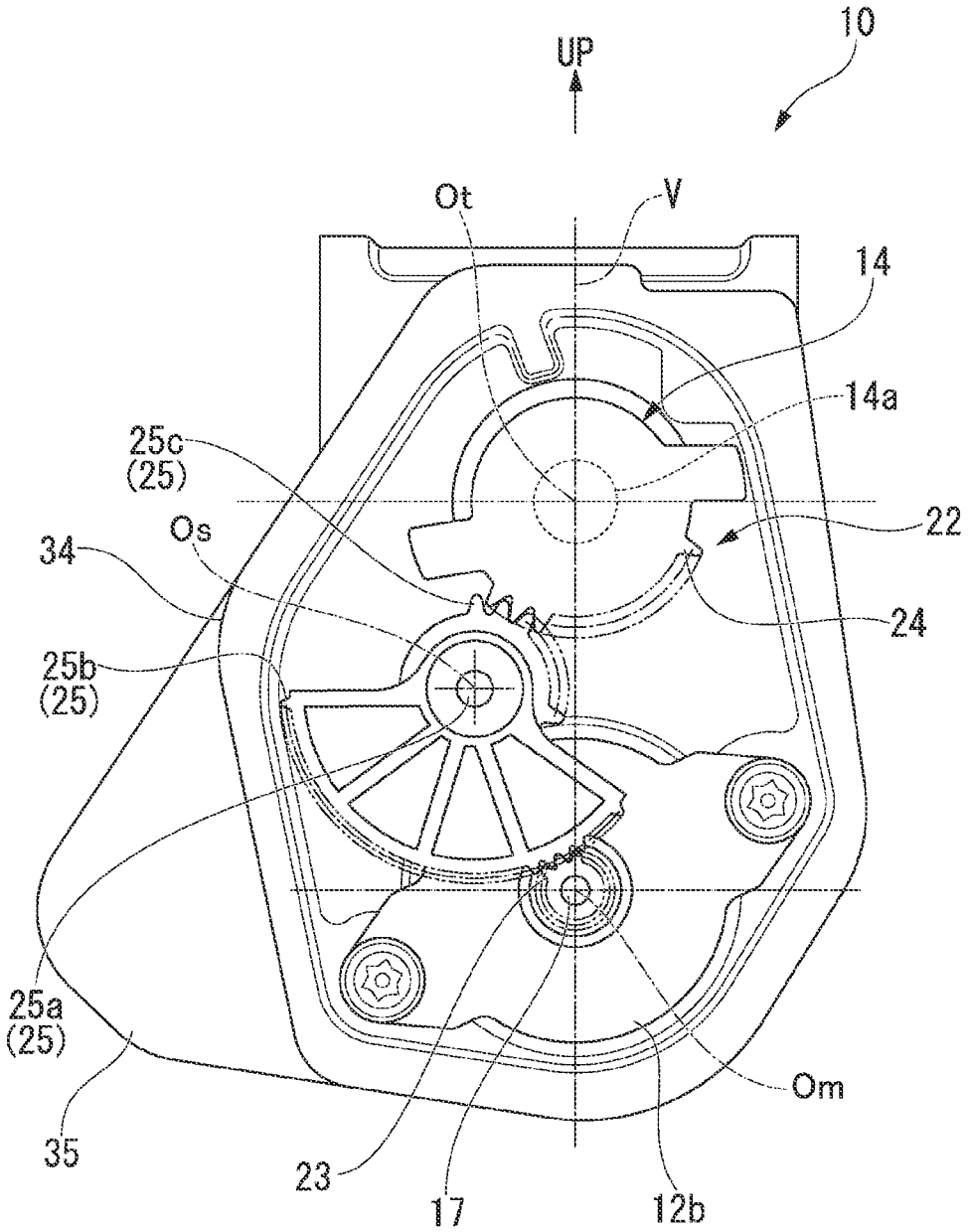
FIG. 5 is an end surface view along a line V-V of FIG. 2 of the throttle apparatus of the embodiment.
Figure 6:
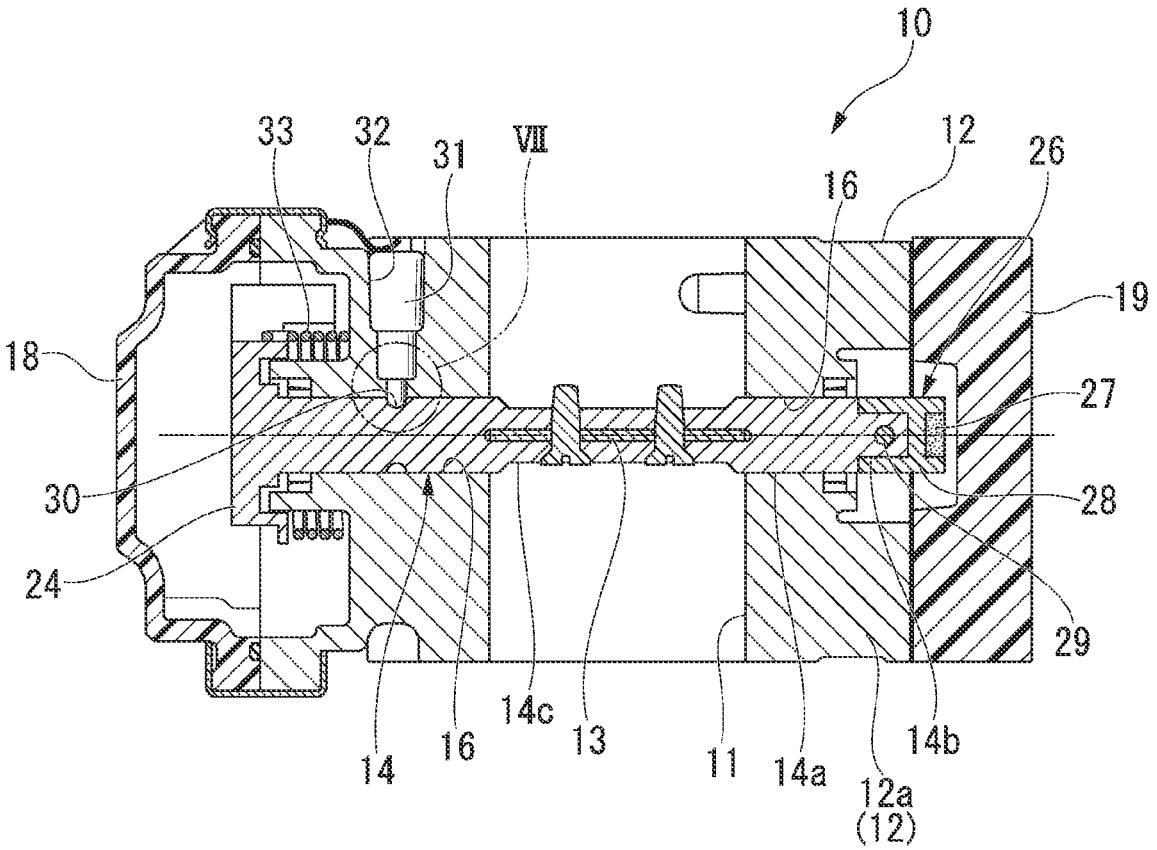
FIG. 6 is a cross-sectional view along a line VI-VI of FIG. 2 of the throttle apparatus of the embodiment.

FIG. 2 is a front view of the throttle apparatus 10, and FIG. 3 is a III arrow view of FIG. 2 of the throttle apparatus 10. FIG. 4 is a cross-sectional view along a IV-IV line of FIG. 3 of the throttle apparatus 10, FIG. 5 is an end surface view along a V-V line of FIG. 2 of the throttle apparatus 10, and FIG. 6 is a cross-sectional view along a VI-VI line of FIG. 2 of the throttle apparatus 10. In the following description of the throttle apparatus 10, for the sake of convenience of explanation, a direction indicated by an arrow UP in the drawing is referred to as "upward", and a direction opposite to the direction indicated by the arrow UP is referred to as "downward".

The throttle apparatus 10 includes: a throttle body 12 that has an intake air introduction hole 11; a throttle valve 13 that opens and closes the intake air introduction hole 11; a throttle shaft 14 that holds the throttle valve 13; and an electrically driven motor 15 that gives a rotation operation force to the throttle shaft 14. An upstream side of the intake air introduction hole 11 of the throttle body 12 is connected to the air cleaner 6, and a downstream side of the intake air introduction hole 11 of the throttle body 12 is connected to the intake pipes 5A and 5B.

In the throttle body 12, a motor housing part 12*b* having a cylindrical shape with a bottom is integrally formed below a body main part 12*a* on which the intake air introduction hole 11 is formed and which has a substantially rectangular shape. A holding hole 16 that extends substantially horizontally so as to be orthogonal to the intake air introduction hole 11 is formed on the body main part 12*a*. A throttle shaft 14 is rotatably supported by the holding hole 16.

Hereinafter, a direction along an axis center Ot of the throttle shaft 14 supported by the holding hole 16 is referred to as an axial direction of the throttle body 12. The throttle shaft 14 penetrates through the holding hole 16 so as to sandwich the intake air introduction hole 11, and both end parts of the throttle shaft 14 protrudes outward in the axial direction of the throttle body 12.

The throttle valve 13 is formed of a plate material having a circular plate shape. The throttle valve 13 is attached integrally to the throttle shaft 14 in an inside of the intake air introduction hole 11 of the throttle body 12. The throttle shaft 14 is operated and rotated, and thereby, the throttle valve 13 changes an opening area of the intake air introduction hole 11.

The electrically driven motor 15 is housed in the motor housing part 12*b* of the throttle body 12. The electrically driven motor 15 is housed in the motor housing part 12*b* along the axial direction of the throttle body 12. The output shaft 17 of the electrically driven motor 15 extends in parallel with the axis center Ot of the throttle shaft 14 and protrudes to one end side in the axial direction of the throttle body 12. Hereinafter, a surface of outer surfaces of the throttle body 12 on a side at which the output shaft 17 of the electrically driven motor 15 protrudes is referred to as a first lateral surface, and a surface of the outer surfaces of the throttle body 12 on a side opposite to the side at which the output shaft 17 protrudes is referred to as a second lateral surface. A surface of the outer surfaces of the throttle body 12 on a side at which an upstream end part of the intake air introduction hole 11 opens is referred to as a front surface, and a surface of the outer surfaces of the throttle body 12 on a side at which a downstream end part of the intake air introduction hole 11 opens is referred to as a rear surface.

A body cover 18 is attached to the first side of the throttle body 12 so as to cover almost the entire area of the first side. A sensor block 19 is attached to part of the second lateral surface of the throttle body 12 at which another end part of the throttle shaft 14 protrudes. The sensor block 19 includes a variety of sensors for detecting a state (for example, a rotation position of the throttle shaft 14, a temperature or a pressure in the vicinity of the throttle valve 13, or the like) of the throttle shaft 14 and in the vicinity thereof. A sensor connector 20 by which an output signal of the internal sensor is extracted to the outside is provided to protrude on a lower surface of the sensor block 19. As shown in FIG. 2 and FIG. 3, a sensor electric cable 21 (signal cable) is connected to the sensor connector 20. The sensor electric cable 21 is connected to a control device (not shown) for controlling a driving state of the general engine 1.

As shown in FIG. 4 and FIG. 5, the throttle apparatus 10 further includes a power transmission mechanism 22 for transmitting a rotation operation force of the electrically driven motor 15 to the throttle shaft 14. The power transmission mechanism 22 is arranged on the first lateral surface of the throttle body 12 and has an outer side that is covered by the body cover 18. The power transmission mechanism 22 includes: a drive gear 23 that is attached to the output shaft 17 of the electrically driven motor 15; a driven gear 24 that is provided on one end part in an axial direction of the throttle shaft 14; and a middle gear 25 that is arranged between the drive gear 23 and the driven gear 24 and that transmits the rotation operation force from the drive gear 23 to the driven gear 24.

The middle gear 25 includes: a support shaft 25*a* that is rotatably supported by the throttle body 12; a first middle gear part 25*b* that is engaged to the drive gear 23; and a second middle gear part 25*c* that is engaged to the driven gear 24. The first middle gear part 25*b* and the second middle gear part 25*c* are coaxially fixed to the support shaft 25*a*. The first middle gear part 25*b* is formed to have an outer diameter which is larger than the second middle gear part 25*c*. The rotation operation force of the electrically driven motor 15 is transmitted from the drive gear 23 to the driven gear 24 such that the speed is reduced to a predetermined deceleration ratio.

The driven gear 24 is integrally formed on the one end part in the axial direction of the throttle shaft 14. The throttle shaft 14 includes: a shaft main body part 14*a* that is held by the holding hole 16 of the throttle body 12; the driven gear 24 that is integrally formed on one end portion in the axial direction of the shaft main body part 14*a*; and a small diameter part 14*b* that is integrally formed on another end portion in the axial direction of the shaft main body part 14*a*. The shaft main body part 14*a*, the driven gear 24, and the small diameter part 14*b* are integrally formed by casting or the like. The driven gear 24 is arranged on one end side (first lateral surface side) in the axial direction of the throttle body 12 in a state where the shaft main body part 14*a* is inserted in the holding hole 16. The small diameter part 14*b* is arranged on another end side in the axial end of the throttle body 12 in a state where the shaft main body part 14*a* is inserted in the holding hole 16. An outer diameter of the small diameter part 14*b* is formed to be smaller than an outer diameter of the shaft main body part 14*a*.

A detected body block 26 of which a rotation position is detected by the sensor inside the sensor block 19 is attached to the small diameter part 14*b* of the throttle shaft 14. The detected body block 26 includes a magnet 27 which is a detected body and a magnet case 28 that has a substantially cylindrical shape and that holds the magnet 27. The magnet case 28 is fitted to the small diameter part 14*b* and is latched and fixed to the small diameter part 14*b* by a support pin 29 that penetrates through the small diameter part 14*b* in a radial direction. An outer diameter (outer diameter of the detected body block 26) of the magnet case 28 that holds the outside of the magnet 27 is formed to be smaller than an inner diameter of the holding hole 16 of the throttle body 12. More specifically, the outer diameter of the detected body block 26 is formed to be an outer diameter that is almost the same as that of a maximum outer diameter portion of the shaft main body part 14*a*.

Further, as shown in FIG. 4 and FIG. 6, an annular groove 30 is formed on part of an outer circumferential surface of the shaft main body part 14*a* closer to the driven gear 24 than a holding part 14*c* with respect to the throttle valve 13. A release restriction pin 31 (release restriction protrusion) that is slidably engaged with the annular groove 30 of the shaft main body part 14*a* and that restricts the release in the axial direction of the shaft main body part 14*a* is attached to the throttle body 12. The release restriction pin 31 is attached to an attachment hole 32 which is formed from the outer surface of the throttle body 12 to be substantially orthogonal to the holding hole 16. A front end part of the release restriction pin 31 is slidably engaged with the annular groove 30.

Figure 7:
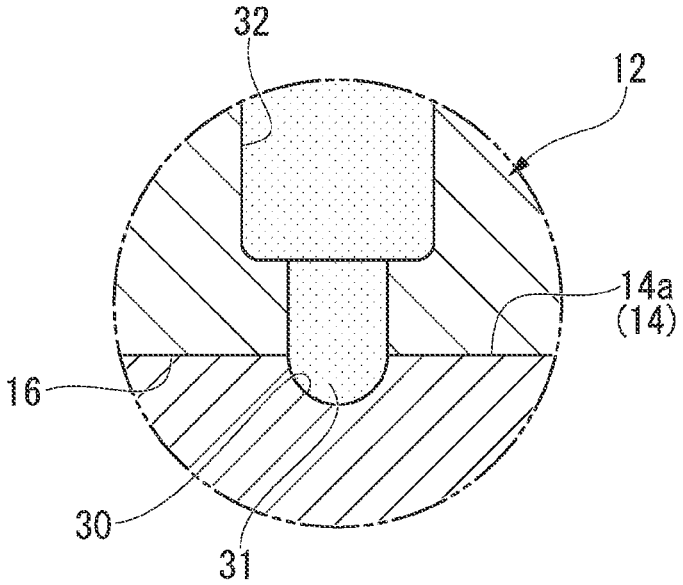
FIG. 7 is an enlarged view of the part VII of FIG. 6 illustrating the throttle apparatus of the embodiment.

FIG. 7 is an enlarged view showing a VII part of FIG. 6. As also shown in FIG. 7, the annular groove 30 and a front end part (contact part) of the release restriction pin 31 are formed in an arc cross-sectional shape. The front end part of the release restriction pin 31 is formed in, more accurately, a substantially hemispherical shape. The release restriction pin 31 is inserted into the attachment hole 32 when the shaft main body part 14*a* of the throttle shaft 14 is inserted in the holding hole 16 from the first lateral surface side of the throttle body 12. At this time, the front end part of the release restriction pin 31 is engaged with the annular groove 30 of the shaft main body part 14*a*, and thereby, the displacement in the axial direction of the throttle shaft 14 is regulated. Then, the release restriction pin 31 is fixed to the attachment hole 32 by any suitable means such as welding.

The detected body block 26 is attached in advance to the small diameter part 14*b* on another end of the throttle shaft 14 before the shaft main body part 14*a* of the throttle shaft 14 is inserted in the holding hole 16 as described above. At this time, since the maximum outer diameter of the detected body block 26 is smaller than the minimum inner diameter of the holding hole 16, the detected body block 26 together with the shaft main body part 14*a* can be smoothly inserted in the holding hole 16.

Further, as shown in FIG. 4 and FIG. 6, a torsion coil spring 33 is provided between the throttle body 12 and the driven gear 24. The torsion coil spring 33 is arranged around the axis center Ot of the throttle shaft 14 and biases the throttle shaft 14 around the axis center. A biasing direction by the torsion coil spring 33 is set to a direction in which the throttle valve 13 blocks the intake air introduction hole 11.

Here, as shown in FIG. 5, the support shaft 25*a* (axis center Os of the support shaft 25*a*) of the middle gear 25 is arranged at a position that is displaced by a predetermined amount rearward from an imaginary straight line V that connects together an axis center Om of the output shaft 17 (motor shaft) of the electrically driven motor 15 and an axis center Ot of the throttle shaft 14. Therefore, a substantially middle area in a vertical direction of an outer surface (rear surface) of the throttle body 12 is formed to project in the rear surface direction by an amount of displacement to the rearward side of the middle gear 25 (first middle gear part 25*b*). The part that projects to the rearward side is referred to as a gear arrangement projection part 34.

Further, a connector arrangement projection part 35 that projects to the rearward side continuously to the gear arrangement projection part 34 is formed on the outer surface (rear surface) of the throttle body 12 below the gear arrangement projection part 34. As shown in FIG. 2, the connector arrangement projection part 35 is formed such that the length in the axial direction is shorter length than that of the motor housing part 12*b* of the throttle body 12. The connector arrangement projection part 35 is arranged to be deviated to one end side (first lateral surface side) of the throttle body 12. A motor connector 36 is provided on another end portion in the axial direction of the connector arrangement projection part 35. The motor connector 36 protrudes toward a second lateral surface direction of the throttle body 12. An electric cable 37 (refer to FIG. 2 and FIG. 3) for supplying electric power to the electrically driven motor 15 is connected to the motor connector 36. The electric cable 37 for the electrically driven motor 15 is bundled with the sensor electric cable 21 and is drawn in a direction of the control device (not shown) at a position close to the throttle body 12 below the front surface side of the throttle body 12.

As described above, in the throttle apparatus 10 of the present embodiment, since the driven gear 24 is molded as an integral component on the throttle shaft 14, it is possible to reduce the number of components and reduce the man-hours of assembly compared to a case in which the driven gear and the throttle shaft are constituted as a separate component.

Further, the throttle apparatus 10 of the present embodiment is formed such that the maximum outer diameter of the detected body block 26 is smaller than the minimum inner diameter of the holding hole 16 of the throttle body 12. Therefore, the throttle shaft 14 can be inserted in the holding hole 16 and be easily attached to the throttle body 12 in a state where the detected body block 26 is attached to the throttle shaft 14 in advance. Accordingly, when the throttle apparatus 10 according to the present embodiment is employed, it is possible to facilitate the fabrication.

Further, in the throttle apparatus 10 of the present embodiment, the small diameter part 14*b* having an outer diameter that is smaller than the shaft main body part 14*a* is formed on the end part in the axial direction of the shaft main body part 14*a*, and the detected body block 26 is fitted to the small diameter part 14*b*. Therefore, the detected body block 26 having an outer diameter that is smaller than the minimum inner diameter of the holding hole 16 can be easily attached to the end part of the shaft main body part 14*a*. Accordingly, when the configuration of the present embodiment is employed, it is possible to further facilitate the fabrication of the throttle apparatus 10.

Further, in the throttle apparatus 10 of the present embodiment, the detected body block 26 includes the magnet 27 that is the detected body and the magnet case 28 that holds the magnet 27, and the magnet case 28 is fitted to the small diameter part 14*b* and is locked to the small diameter part 14*b* by the support pin 29 that penetrates through the small diameter part 14*b* in the radial direction. Accordingly, when the configuration of the present embodiment is employed, the magnet case 28 that holds the magnet 27 can be easily and stably attached to the end part in the axial direction of the shaft main body part 14*a*.

The present invention is not limited to the embodiment described above, and various design changes can be made without departing from the scope of the invention. For example, the general engine 1 of the embodiment described above is a V-type dual cylinder engine; however, the arrangement shape and the number of cylinders are not limited thereto and are arbitrary. Further, the protrusion direction of the crankshaft 2 is also not limited to the horizontal direction and may be the vertical direction.

DESCRIPTION OF THE REFERENCE SYMBOLS

1 General engine
10 Throttle apparatus
11 Intake air introduction hole
12 Throttle body
13 Throttle valve
14 Throttle shaft
14*a* Shaft main body part
14*b* Small diameter part
15 Electrically driven motor
16 Holding hole
24 Driven gear
26 Detected body block
27 Magnet
28 Magnet case
29 Support pin

The invention claimed is:

1. A general engine throttle apparatus that is a throttle apparatus of a general engine, the apparatus comprising:

a throttle body that has an intake air introduction hole;

a throttle valve that opens and closes the intake air introduction hole;

a throttle shaft that holds the throttle valve and that is rotatably supported by a holding hole of the throttle body;

a driven gear that is provided on one end part in an axial direction of the throttle shaft;

an electrically driven motor that transmits a rotation operation force to the driven gear; and a detected body block which is attached to another end part in the axial direction of the throttle shaft and in which a state of the throttle shaft is detected by a sensor, wherein the driven gear and the detected body block are arranged on one end part and another end part of the throttle shaft that protrudes to an outside of the holding hole, respectively, and wherein the driven gear is integrally formed on one end side in the axial direction of the throttle shaft, the sensor detects a state of the detected body block, and the detected body block is formed to have a maximum outer diameter that is smaller than a minimum inner diameter of the holding hole.

2. The general engine throttle apparatus according to claim 1, wherein a small diameter part having an outer diameter that is smaller than a shaft main body part held by the holding hole is formed on the other end part in the axial direction of the throttle shaft, and the detected body block is fitted to the small diameter part.

3. A general engine throttle apparatus that is a throttle apparatus of a general engine, the apparatus comprising:

a throttle body that has an intake air introduction hole;

a throttle valve that opens and closes the intake air introduction hole;

a throttle shaft that holds the throttle valve and that is rotatably supported by a holding hole of the throttle body;

a driven gear that is provided on one end part in an axial direction of the throttle shaft;

an electrically driven motor that transmits a rotation operation force to the driven gear; and a detected body block which is attached to another end part in the axial direction of the throttle shaft and in which a state of the throttle shaft is detected by a sensor, wherein the driven gear and the detected body block are arranged on one end part and another end part of the throttle shaft that protrudes to an outside of the holding hole, respectively, wherein the driven gear is integrally formed on one end side in the axial direction of the throttle shaft, and the detected body block is formed to have a maximum outer diameter that is smaller than a minimum inner diameter of the holding hole, wherein a small diameter part having an outer diameter that is smaller than a shaft main body part held by the holding hole is formed on the other end part in the axial direction of the throttle shaft, and the detected body block is fitted to the small diameter part, and wherein the detected body block includes a magnet that is a detected body and a magnet case that holds the magnet, and the magnet case is fitted to the small diameter part and is locked to the small diameter part by a support pin that penetrates through the small diameter part in a radial direction.

* * * * *